US010808645B2

(12) United States Patent
Kaneda

(10) Patent No.: US 10,808,645 B2
(45) Date of Patent: Oct. 20, 2020

(54) CYLINDER HEAD COVER

(71) Applicant: TOYOTA JIDOSHA KABUSHIKI KAISHA, Aichi-ken (JP)

(72) Inventor: Ryo Kaneda, Okazaki (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/283,826

(22) Filed: Feb. 25, 2019

(65) Prior Publication Data

US 2019/0323449 A1 Oct. 24, 2019

(30) Foreign Application Priority Data

Apr. 24, 2018 (JP) ..... 2018-082914

(51) Int. Cl.

| | |
|---|---|
| ***F02F 1/24*** | (2006.01) |
| ***F02M 55/02*** | (2006.01) |
| ***F02M 39/00*** | (2006.01) |
| ***F02F 7/00*** | (2006.01) |

(52) U.S. Cl.
CPC ..... *F02F 1/24* (2013.01); *F02F 7/006* (2013.01); *F02M 39/00* (2013.01); *F02M 55/02* (2013.01); *F02F 2007/0063* (2013.01)

(58) Field of Classification Search
CPC ..... F02F 1/24; F02F 7/006; F02F 2007/0063; F02M 55/02; F02M 55/005; F02M 39/00
See application file for complete search history.

(56) References Cited

U.S. PATENT DOCUMENTS

2005/0076870 A1 4/2005 Nakamura et al.
2014/0230765 A1* 8/2014 Laichinger ..... F02F 7/0021 123/90.38

FOREIGN PATENT DOCUMENTS

JP 2005-113850 A 4/2005
JP 2011-256731 A 12/2011

* cited by examiner

*Primary Examiner* — Jacob M Amick
(74) *Attorney, Agent, or Firm* — Hauptman Ham, LLP

(57) ABSTRACT

A cylinder head cover includes: a body; and a high rigidity part having a higher rigidity than the body; wherein a part between both ends of a fuel pipe is mounted to the high rigidity part.

20 Claims, 2 Drawing Sheets

CYLINDER HEAD COVER

CROSS-REFERENCE TO RELATED APPLICATION

This application is based upon and claims the benefit of priority of the prior Japanese Patent Application No. 2018-082914, filed on Apr. 24, 2018, the entire contents of which are incorporated herein by reference.

TECHNICAL FIELD

The present disclosure relates to a cylinder head cover.

BACKGROUND

A cylinder head is mounted on a cylinder block of an internal combustion engine, and a cylinder head cover is mounted on the cylinder head (e.g. Japanese Unexamined Patent Application Publication No. 2011-256731). The cylinder head cover is made of resin, for example, and covers the cylinder head.

A fuel pipe is used to supply a fuel to the internal combustion engine. To suppress the vibration of the fuel pipe, the fuel pipe is fixed between both ends thereof. For example, due to the layout or the like of members of the internal combustion engine, the fuel pipe may be extended on the cylinder head cover. In this case, the fuel pipe is fixed to the cylinder head cover. However, the cylinder head cover causes membrane vibration, so that the fuel pipe also vibrates greatly and might be damaged.

SUMMARY

It is an object of the present disclosure to provide a cylinder head cover that can suppress the damage of the fuel pipe.

The above object is achieved by a cylinder head cover including: a body; and a high rigidity part having a higher rigidity than the body; wherein a part between both ends of a fuel pipe is mounted to the high rigidity part.

The high rigidity part may be a flange part formed on an outer periphery of the body, and the flange part may be used to attach the cylinder head cover to an external member.

The flange part may be thicker than the body.

The cylinder head cover may be mounted to a cylinder head, the body may cover the cylinder head, and the fuel pipe may be overlapped with the body and extend to the cylinder head.

The fuel pipe may be mounted to the high rigidity part of the cylinder head cover and need not be mounted to a part other than the high rigidity part.

The fuel pipe may be fixed to a fixing member, and the fixing member may be mounted to the high rigidity part.

DETAILED DESCRIPTION

Hereinafter, a description will be given of a cylinder head cover of the present embodiment with reference to drawings.

Figure 1:
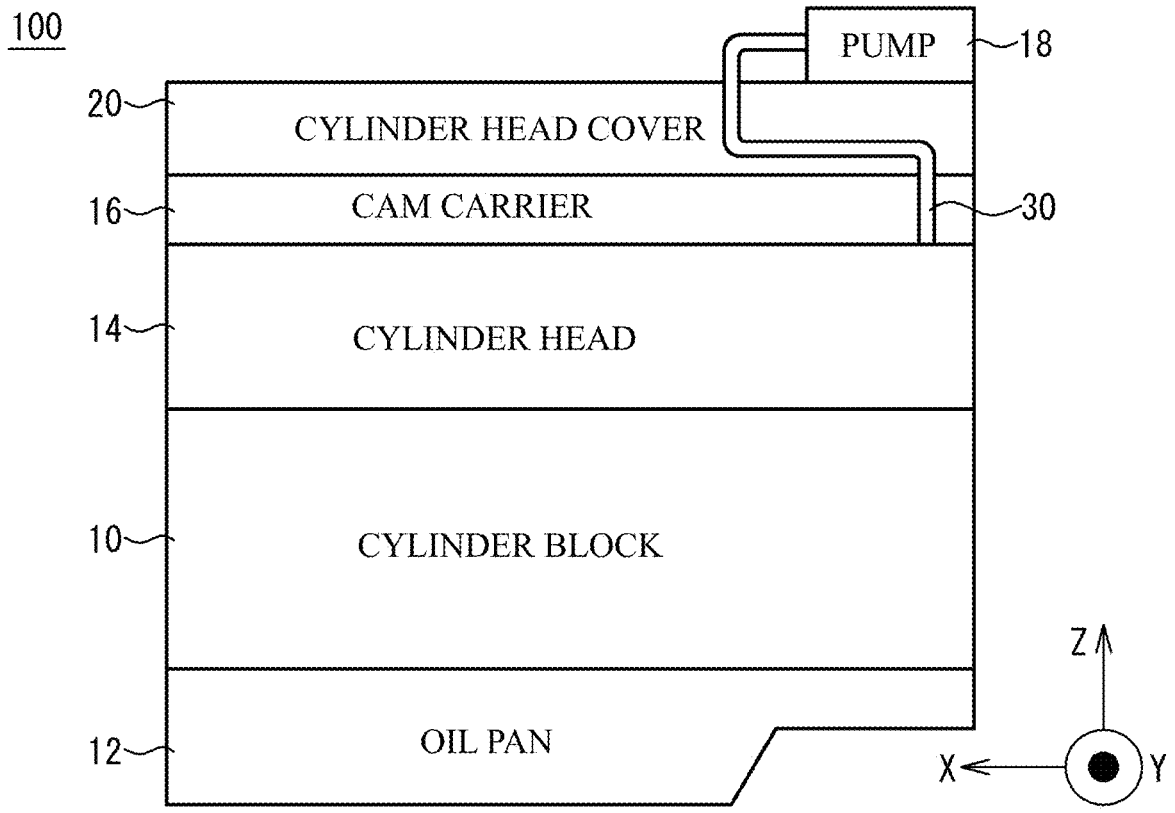
FIG. 1 is a schematic diagram illustrating an internal combustion engine including a cylinder head cover.

FIG. 1 is a schematic diagram illustrating an internal combustion engine 100 including the cylinder head cover. The internal combustion engine 100 is, for example, an internal combustion (engine) such as a gasoline engine and a diesel engine, and is mounted on a vehicle.

(Internal Combustion Engine 100) As illustrated in FIG. 1, the internal combustion engine 100 includes a cylinder block 10, a cylinder head 14, a cam carrier 16, a cylinder head cover 20 and an oil pan 12. The oil pan 12 is mounted under the cylinder block 10 to store an oil. A crankshaft, a piston and the like, not illustrated, are housed in the cylinder block 10. The cylinder head 14 is mounted on the cylinder block 10, and an exhaust valve, an intake valve and a fuel injection valve and so on, not illustrated, are provided on the cylinder head 14. The cam carrier 16 is mounted on the cylinder head 14 to hold the camshaft, not illustrated. The cylinder head cover 20 is mounted on the cam carrier 16 and covers the cylinder head 14.

The oil pan 12, the cylinder block 10, the cylinder head 14 and the cam carrier 16 are made of metal, for example. The cylinder head cover 20 is made of resin, for example.

For example, a pump 18 is disposed on the cylinder head cover 20. One end of a fuel pipe 30 is connected to the pump 18, and the other end thereof is connected to the cylinder head 14. The fuel pipe 30 extends from the pump 18 to the cylinder head 14, and a part of the fuel pipe 30 overlaps the cylinder head cover 20. A fuel is supplied to a high-pressure delivery pipe in the cylinder head 14 from the pump 18 through the fuel pipe 30.

Figure 2A:
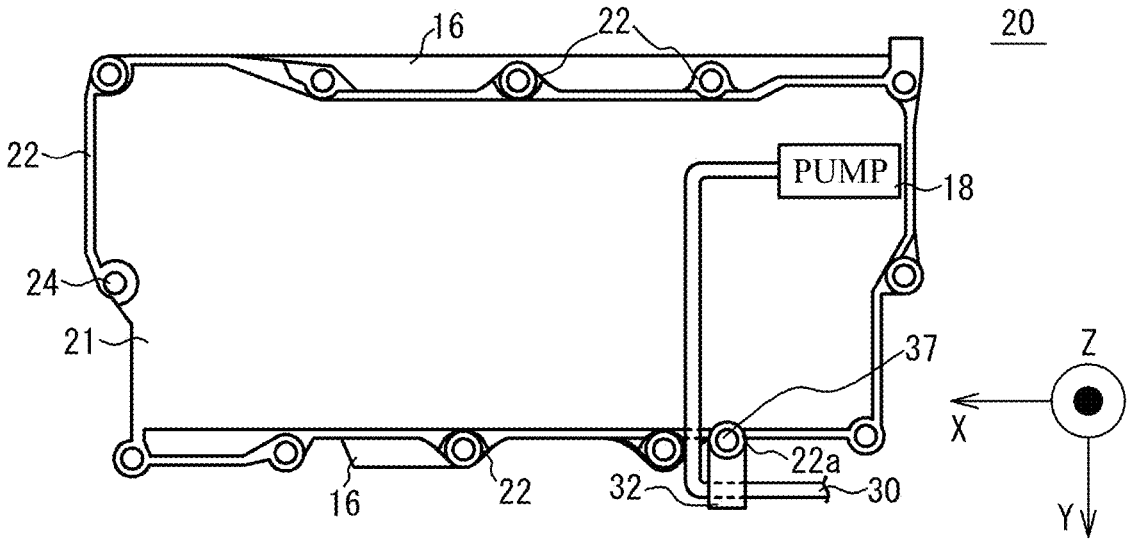
FIG. 2A is a plan view illustrating the cylinder head cover.

(Cylinder Head Cover 20) FIG. 2A is a plan view illustrating the cylinder head cover 20, and illustrates an upper surface thereof. The cylinder head cover 20 has a body 21 and a plurality of flange parts 22. A Z-direction is a direction in which the cylinder block 10, the cylinder head 14 and the cylinder head cover 20 are stacked. An XY-plane is a surface in which the body 21 of the cylinder head cover 20 spreads.

The body 21 and the flange parts 22 are integrally molded with the resin. The body 21 covers the cylinder head 14. The plurality of flange parts 22 are provided on an outer periphery of the body 21, and a hole 24 is provided in each flange part 22. A bolt is fastened to the hole 24, so that the cam carrier 16 is mounted to the cylinder head cover 20.

A fixing member 32 is mounted to a part 22*a* among the plurality of flange parts 22, and the fuel pipe 30 is fixed to the fixing member 32. The fuel pipe 30 mainly extends in the XY-plane toward the fixing member 32 from the pump 18, extends downward (−Z direction) from the fixing member 32, and reaches the cylinder head 14 as illustrated in FIG. 1.

Figure 2B:
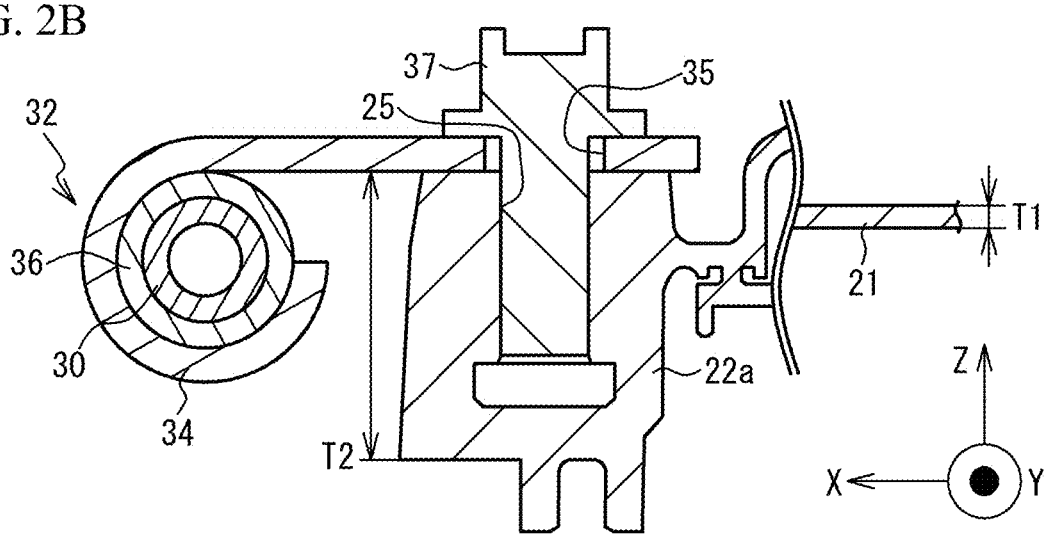
FIG. 2B is a cross-sectional view enlarging a vicinity of a fixing member.

FIG. 2B is a cross-sectional view enlarging a vicinity of the fixing member 32. The fixing member 32 includes a body 34 and a cylindrical part 36. The body 34 is, for example, made of metal and has a J-shape. The cylindrical part 36 is, for example, a rubber cylinder, and is fitted into the body 34. The fuel pipe 30 is inserted into the cylindrical part 36, thereby being fixed to the fixing member 32.

A bolt 37 is inserted into a hole 25 of the part 22*a* of the cylinder head cover 20 and a hole 35 of the fixing member 32, so that the fixing member 32 is mounted to the part 22*a*. Thus, the fuel pipe 30 is mounted to the part 22*a*. As compared to a thickness T1 of the body 21, the thickness T2 of the part 22*a* is large, and is more than twice the T1, for example. Therefore, the part 22*a* has a higher rigidity than the body 21.

According to the present embodiment, the fuel pipe 30 is mounted to the part 22*a* of the flange parts 22 with the use of the fixing member 32. Since the flange parts 22 have the higher rigidity than the body 21, it is hardly vibrated.

Therefore, the fuel pipe 30 is also hardly vibrated, and the damage thereof is suppressed.

The flange parts 22 are used to mount the cylinder head cover 20 to the cam carrier 16. That is, the flange parts 22 are fixed to the cam carrier 16 by the bolts to be inserted into the holes 24 of the flange parts 22. Therefore, the flange parts 22 are more hardly vibrated than the body 21. By mounting the fuel pipe 30 to one of the flange parts 22, the vibration of the fuel pipe 30 is also further reduced, and the damage thereof is effectively suppressed.

The flange parts 22 are thicker than the body 21. Therefore, the rigidity of the flange parts 22 is increased, and the vibration of the fuel pipe 30 is suppressed. In particular, the cylinder head cover 20 made of resin is easily vibrated as compared to that made of metal. Even if the cylinder head cover 20 is made of resin, the flange parts 22 are thick and have the high rigidity, and therefore are hardly vibrated. Therefore, by mounting the fuel pipe 30 to one of the flange parts 22, the vibration of the fuel pipe 30 is reduced and the damage thereof is suppressed.

The part 22*a* of the flange part 22 is thicker than the other parts of the flange part 22 and the body 21. The thickness T2 of the part 22*a* is more than twice, 5 times or 10 times the thickness T1 of the body 21, for example. This increases the rigidity of the part 22*a*, and it is possible to effectively suppress the vibration of the fuel pipe 30.

The fuel pipe 30 is provided so as to overlap with the cylinder head cover 20 depending on the layout of the internal combustion engine 100 and surrounding parts. The fuel pipe 30 is long enough to reach the cylinder head 14 from the pump 18, and is fixed at not only both ends thereof but between both ends thereof in order to suppress the vibration of the fuel pipe 30. Since the body 21 of the cylinder head cover 20 causes membrane vibration, when the fuel pipe 30 is mounted to the body 21, the fuel pipe 30 also greatly vibrates along with the body 21 and can be damaged. In the present embodiment, the fuel pipe 30 is mounted to one of the flange parts 22, so that the vibration of the fuel pipe 30 is reduced and the damage of the fuel pipe 30 is suppressed.

The fuel pipe 30 may be mounted to any of the plurality of flange parts 22, but is preferably mounted to one of the flange parts 22 close to the center of the fuel pipe 30. In the present embodiment, the fuel pipe 30 is mounted to the part 22*a* of the flange part 22 located near the center of the fuel pipe 30. That is, the fuel pipe 30 is fixed at three places near both ends and the center thereof, so that the vibration of the fuel pipe 30 is further reduced and the damage of the fuel pipe 30 is effectively suppressed.

To improve an intensity of the cylinder head cover 20, a rib may be provided in the body 21. Since the rib has a higher rigidity than the body 21, the fuel pipe 30 may be mounted to the rib, for example. Here, to fix the vicinity of the center of the fuel pipe 30, the fuel pipe 30 is preferably mounted to the flange part 22.

It is preferably that the fuel pipe 30 is mounted to a part having a high rigidity such as the flange part 22, and not mounted to the other part. When the fuel pipe 30 is mounted to a part having a low rigidity such as the body 21, the vibration of the fuel pipe 30 increases and cracks may occur in the fuel pipe 30. Another fixing member different from the fixing member 32 of FIGS. 2A and 2B may be used, and may fix the fuel pipe 30.

Although some embodiments of the present disclosure have been described in detail, the present disclosure is not limited to the specific embodiments but may be varied or changed within the scope of the present disclosure as claimed.

What is claimed is:

1. A cylinder head cover comprising:

a body;

a high rigidity part having a higher rigidity than the body; and a fixing member extending from the high rigidity part, wherein a part between both ends of a fuel pipe is mounted to the high rigidity part by the fixing member, and the fixing member continuously extends from above a top-most surface of the fuel pipe to below a bottom-most surface of the fuel pipe.

2. The cylinder head cover as claimed in claim 1, wherein the high rigidity part is a flange part formed on an outer periphery of the body, and the flange part is usable to attach the cylinder head cover to an external member.

3. The cylinder head cover as claimed in claim 2, wherein the flange part is thicker than the body.

4. The cylinder head cover as claimed in claim 1, wherein the cylinder head cover is mounted to a cylinder head, the body covers the cylinder head, and the fuel pipe is overlapped with the body and extends to the cylinder head.

5. The cylinder head cover as claimed in claim 1, wherein the fuel pipe is mounted to the high rigidity part of the cylinder head cover and not mounted to a part other than the high rigidity part.

6. The cylinder head cover as claimed in claim 1, wherein the fixing member is mounted directly to the high rigidity part.

7. The cylinder head cover as claimed in claim 1, wherein the body comprises resin, and the fixing member comprises metal.

8. The cylinder head cover as claimed in claim 1, wherein the fixing member comprises an opening for receiving a bolt for mounting the fixing member to the high rigidity part.

9. The cylinder head cover as claimed in claim 8, wherein the fixing member is immovable relative to the high rigidity part.

10. The cylinder head cover as claimed in claim 1, further comprising a cylindrical part between the fixing member and the fuel pipe.

11. The cylinder head cover as claimed in claim 10, wherein the cylindrical part completely surrounds the fuel pipe.

12. The cylinder head cover as claimed in claim 11, wherein a portion of the cylindrical part is exposed by the fixing member.

13. The cylinder head cover as claimed in claim 1, wherein a thickness of the high rigidity part is 5 times to 10 times greater than a thickness of the body.

14. The cylinder head cover as claimed in claim 1, wherein the high rigidity part comprises resin, and the fixing member comprises metal.

15. An engine comprising:

a cylinder block;

a cylinder head mounted to the cylinder block;

a cam carrier mounted to the cylinder head;

a cylinder head cover mounted to the cam carrier, wherein the cylinder head cover comprises:

a body;

a high rigidity part having a higher rigidity than the body; and a continuous fixing member extending from the high rigidity part;

a pump; and a fuel pipe extending from the pump to the cylinder head, wherein the fuel pipe is mounted to the high rigidity part by the fixing member, and the continuous fixing member extends from above a top-most surface of the fuel pipe to below a bottom-most surface of the fuel pipe.

16. The engine as claimed in claim 15, wherein the continuous fixing member is immovable relative to the high rigidity part.

17. The engine as claimed in claim 15, wherein a thickness of the high rigidity part is 5 times to 10 times greater than a thickness of the body.

18. The engine as claimed in claim 15, wherein the high rigidity part comprises a resin, and the fixing member comprises metal.

19. The engine as claimed in claim 18, wherein the body comprises the resin.

20. An engine comprising:

a cylinder block;

an oil pan mounted to a first surface of the cylinder block;

a cylinder head mounted to a second surface of the cylinder block;

a cam carrier mounted to the cylinder head;

a cylinder head cover mounted to the cam carrier, wherein the cylinder head cover comprises:

a body, wherein the body comprises a resin;

a high rigidity part having a higher rigidity than the body, wherein the high rigidity part has a thickness 5 times to 10 times greater than a thickness of the body, and the high rigidity part comprises the resin; and a fixing member extending from the high rigidity part, wherein the fixing member comprises metal;

a pump; and a fuel pipe extending from the pump to the cylinder head, wherein the fuel pipe is mounted to the high rigidity part by the fixing member, and the fixing member extends from above a top-most surface of the fuel pipe to below a bottom-most surface of the fuel pipe.

* * * * *